US011754081B2

(12) United States Patent
Nishimura

(10) Patent No.: US 11,754,081 B2
(45) Date of Patent: Sep. 12, 2023

(54) VACUUM PUMP AND LEAK DETECTOR

(71) Applicant: SHIMADZU CORPORATION, Kyoto (JP)

(72) Inventor: Taiki Nishimura, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 17/699,317

(22) Filed: Mar. 21, 2022

(65) Prior Publication Data

US 2022/0389933 A1 Dec. 8, 2022

(30) Foreign Application Priority Data

Jun. 2, 2021 (JP) ..... 2021-092813

(51) Int. Cl.

| | |
|---|---|
| ***F04D 29/32*** | (2006.01) |
| ***F04D 29/52*** | (2006.01) |
| ***F04D 19/04*** | (2006.01) |
| ***F04D 27/00*** | (2006.01) |

(52) U.S. Cl.

CPC ..... *F04D 27/001* (2013.01); *F04D 19/04* (2013.01); *F04D 19/042* (2013.01); *F04D 29/32* (2013.01); *F04D 29/522* (2013.01)

(58) Field of Classification Search

CPC ..... F04D 19/04; F04D 19/042; F04D 29/32; F04D 29/522; F04D 19/048; F04D 29/644; F05D 2240/511

See application file for complete search history.

(56) References Cited

U.S. PATENT DOCUMENTS

| | | | | |
|---|---|---|---|---|
| 4,787,829 | A * | 11/1988 | Miyazaki | F04D 19/048 417/423.4 |
| 2003/0180162 | A1* | 9/2003 | Beyer | F04D 29/058 417/423.4 |
| 2008/0112660 | A1* | 5/2008 | Koch | F16C 33/664 384/397 |
| 2020/0378857 | A1* | 12/2020 | Manabe | F04D 19/046 |

FOREIGN PATENT DOCUMENTS

| | | | | |
|---|---|---|---|---|
| EP | 3617523 | A1 * | 3/2020 | F04D 19/042 |
| JP | 2020197127 | A | 12/2020 | |

* cited by examiner

*Primary Examiner* — Brian Christopher Delrue
(74) *Attorney, Agent, or Firm* — Renner, Otto, Boisselle & Sklar, LLP

(57) ABSTRACT

A vacuum pump comprises: a rotor rotatable in a predetermined rotation direction; and a case housing the rotor; and a fixed component arranged facing an inner wall of the case. A clearance is formed between the inner wall of the case and the fixed component, and a groove allowing communication between the clearance and an exhaust path in the case is formed at either the inner wall of the case or the fixed component.

6 Claims, 9 Drawing Sheets

VACUUM PUMP AND LEAK DETECTOR

BACKGROUND OF THE INVENTION

1. Technical Field

The present invention relates to a vacuum pump and a leak detector.

2. Background Art

A turbo-molecular pump is utilized as a vacuum pump for ultra-high vacuum or a vacuum pump for a leak detector. In the turbo-molecular pump, a rotor is housed in a case, and the rotor is rotated with tens of thousands of rotations to perform vacuum pumping.

There has been a problem that in the rotor rotating at a high speed, if a closed space is caused at a portion where components are combined, slow leak that gas enclosed in the closed space gradually leaks is caused. Patent Literature 1 (JP-A-2020-197127) discloses such a technique that a closed space at a rotor portion is eliminated for preventing slow leak.

SUMMARY OF THE INVENTION

The vacuum pump has a probability that a gas-accumulated space is caused between the case and a component fixed to the case and the slow leak is caused accordingly. An object of the present disclosure is to provide the technique of eliminating such a gas-accumulated space to prevent the slow leak.

A vacuum pump comprises: a rotor rotatable in a predetermined rotation direction; and a case housing the rotor; and a fixed component arranged facing an inner wall of the case. A clearance is formed between the inner wall of the case and the fixed component, and a groove allowing communication between the clearance and an exhaust path in the case is formed at either the inner wall of the case or the fixed component.

A vacuum pump of the present disclosure is configured such that a clearance is formed between a case and a fixed component fitted in and arranged on an inner wall of the case and a groove for discharging gas from the clearance is provided at the case or the fixed component. Thus, the slow leak can be reduced.

A leak detector comprises: the vacuum pump including a first suction port, an exhaust port, and a second suction port connected to an exhaust path between the first suction port and the exhaust port; and an analyzer tube configured to detect leak checking gas. The analyzer tube is connected to the first suction port of the vacuum pump, and a test sample is connected to the second suction port of the vacuum pump.

Since the slow leak in the vacuum pump is reduced, a leak detector of the present disclosure is configured so that time until a leak rate decreases to around a background can be shortened and leak check can be quickly performed in a single test.

DETAILED DESCRIPTION OF THE EXEMPLARY EMBODIMENTS

First Embodiment

Figure 1:
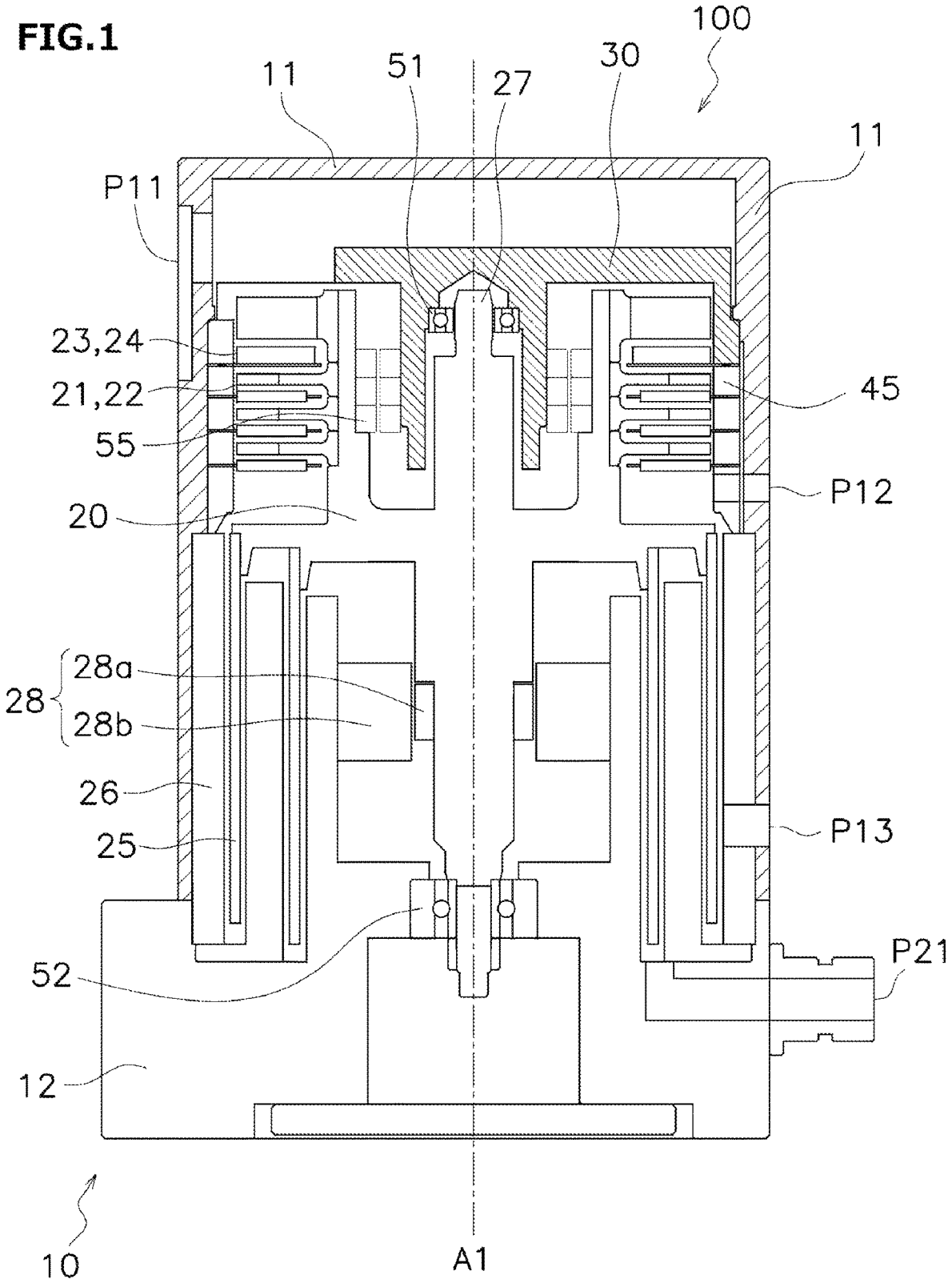
FIG. 1 is a sectional view of a vacuum pump 100 of a first embodiment.

As shown in FIG. 1, a vacuum pump 100 of a first embodiment includes a housing 10, a rotor 20, a motor 28, a magnet holder 30, multiple stages of stator blade units 23, a stator cylindrical portion 26, and bearings 51, 52, 55. The housing 10 includes a case 11 and a base 12. The housing 10 houses the rotor 20, the motor 28, the magnet holder 30, the multiple stages of the stator blade units 23, the stator cylindrical portion 26, and the bearings 51, 52, 55.

As shown in FIG. 1, the housing 10 includes a first suction port P11, second suction ports P12, P13, and an exhaust port P21. An exhaust target device including an exhaust target space is connected to the first suction port P11. An auxiliary pump is connected to the exhaust port P21. In an internal space of the housing 10, an exhaust path from the first suction port P11 to the exhaust port P21 is formed. The multiple second suction ports P12, P13 are connected to the exhaust path. When the vacuum pump 100 is used as a leak detector, pipes from a test sample are each connected to the multiple second suction ports P12, P13.

The rotor 20 includes a shaft 27, multiple stages of rotor blade units 21, and a rotor cylindrical portion 25.

The shaft 27 extends in an axial direction A1 of the rotor 20. In description below, in the axial direction A1, a direction from the case 11 toward the base 12 is defined as a lower side, and the opposite direction thereof is defined as an upper side.

The shaft 27 is rotatably fixed to the housing 10 by the bearings 51, 52 and the magnetic bearing 55. More specifically, the upper side of the shaft 27 is fixed to the magnet holder 30 by the bearing 51 and the magnetic bearing 55, and the magnet holder 30 is fixed to the case 11. The lower side of the shaft 27 is fixed to the base 12 by the bearing 52.

The motor 28 rotatably drives the rotor 20. The motor 28 includes a motor rotor 28*a* and a motor stator 28*b*. The motor rotor 28*a* is attached to the shaft 27. The motor stator 28*b* is attached to the base 12. The motor stator 28*b* is arranged facing the motor rotor 28*a*.

The multiple rotor blade units 21 are connected to the shaft 27. The multiple stages of the rotor blade units 21 are arranged at intervals in the axial direction A1. Each rotor blade unit 21 includes multiple rotor blades 22. Although not shown in the figure, the multiple rotor blades 22 radially extends about the shaft 27. Note that in the drawing, reference numerals are assigned only to one of the multiple rotor blade units 21 and one of the multiple rotor blades 22 and reference numerals for the other rotor blade units 21 and the other rotor blades 22 are omitted.

Each of the multiple stages of the stator blade units 23 is stacked on an inner surface of the case 11 with such a stator blade unit 23 being sandwiched between adjacent two of spacers 45 arranged one above the other. The multiple stages of the stator blade units 23 are arranged at intervals in the axial direction A1. Each of the multiple stages of the stator blade units 23 is arranged between adjacent ones of the multiple stages of the rotor blade units 21. Each stator blade unit 23 includes multiple stator blades 24. Although not shown in the figure, the multiple stator blades 24 radially extend about the shaft 27.

The multiple stages of the rotor blade units 21 and the multiple stages of the stator blade units 23 form a turbo-molecular pump. Note that in the drawing, reference numerals are assigned only to one of the multiple stator blade units 23 and one of the multiple stator blades 24 and reference numerals for the other stator blade units 23 and the other stator blades 24 are omitted.

The rotor cylindrical portion 25 is arranged below the rotor blade units 21. The rotor cylindrical portion 25 extends in the axial direction A1.

The stator cylindrical portion 26 is arranged outside the rotor cylindrical portion 25 in a radial direction. The stator cylindrical portion 26 is fixed to the housing 10. The stator cylindrical portion 26 is, in the radial direction of the rotor cylindrical portion 25, arranged facing the rotor cylindrical portion 25. A spiral groove is provided at an inner peripheral surface of the stator cylindrical portion 26. The rotor cylindrical portion 25 and the stator cylindrical portion 26 form a screw groove pump.

Figure 3:
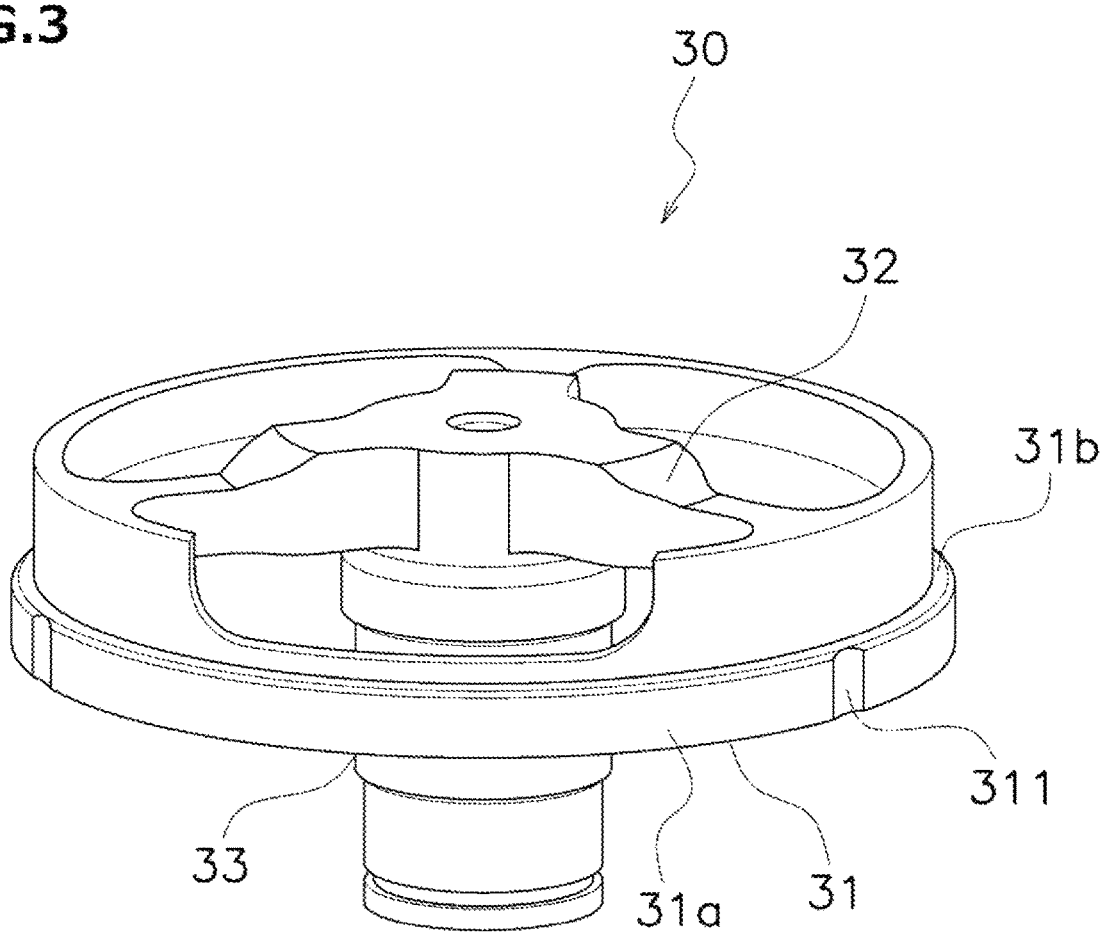
FIG. 3 is a perspective view of the magnet holder 30 in the first embodiment.

The magnet holder 30 holds a permanent magnet of the magnetic bearing 55 on an inner peripheral side thereof, and determines the radial direction and axial direction of the permanent magnet on the inner peripheral side. The magnet holder 30 is fitted in an inner wall of the case 11, and therefore, is arranged above the shaft 27 of the rotor 20. As shown in FIG. 3, the magnet holder 30 includes a center portion 33, an outer ring portion 31, and beams 32 connecting the center portion 33 and the outer ring portion 31 to each other. The outer ring portion 31 is fitted in the inner wall of the case 11. The permanent magnet of the magnetic bearing 55 on the inner peripheral side thereof is fixed to the center portion 33. On the other hand, a permanent magnet of the magnetic bearing 55 on an outer peripheral side thereof is fixed to the rotor 20. By repulsive force between the permanent magnets of the magnetic bearing 55 on the inner and outer peripheral sides thereof, the rotor 20 is levitated upwardly to a predetermined position in the axial direction A1.

Figure 2:
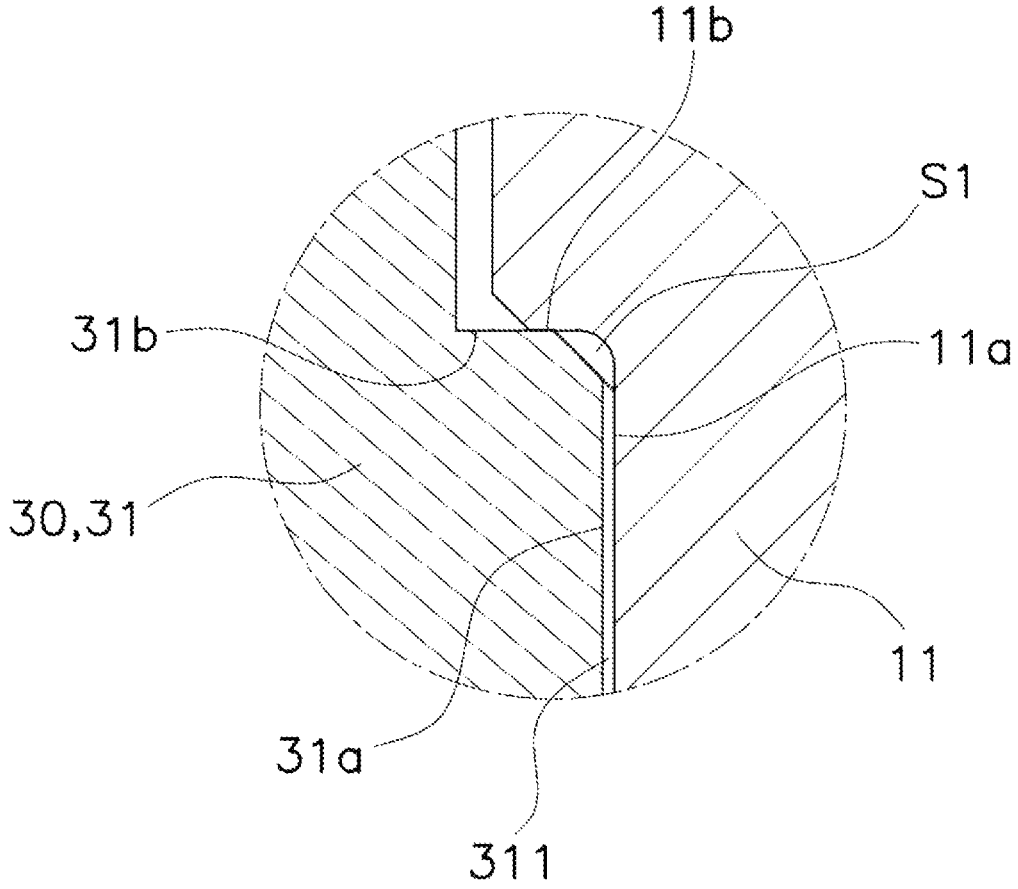
FIG. 2 is an enlarged view of a fitting portion between a step of an inner wall of a case 11 and a magnet holder 30 in the first embodiment.

As shown in FIG. 3, a step is formed at the outer ring portion 31 of the magnet holder 30. The step includes an outer peripheral surface 31*a* and a surface 31*b* extending in the radial direction. Moreover, a step is also formed at the inner wall of the case 11. As shown in FIG. 2, the step includes a surface 11*a* extending in the upper-lower direction and a surface 11*b* extending in the radial direction. The outer peripheral surface 31*a* of the magnet holder 30 is fitted in contact with the inner wall surface 11*a* of the case 11. The surface 31*b* of the magnet holder 30 contacts the surface 11*b* of the case 11 forming the step. Due to such a configuration, a clearance S1 between the case 11 and the magnet holder 30 is formed at the step of the inner wall of the case 11. If the clearance S1 is a closed space, a gas-accumulated space is formed, leading to slow leak.

In the present embodiment, grooves 311 are formed at the outer peripheral surface 31*a* of the outer ring portion 31 of the magnet holder 30. The grooves 311 cause the clearance S1 to communicate with other spaces in the case 11. The other spaces form the exhaust path. Thus, gas is easily discharged from the clearance S1, and the slow leak is reduced. Specifically, the grooves 311 communicate with a minute clearance (see FIG. 1) among the spacers 45 and the case 11. The clearance among the spacers 45 and the case 11 communicates with the second suction port P12 on the lower side, and therefore, communicates with the exhaust path between the turbo-molecular pump and the screw groove pump. Thus, gas in the clearance S1 is discharged to the exhaust path between the turbo-molecular pump and the screw groove pump by way of the grooves 311 and the clearance among the spacers 45 and the case 11.

Figure 4:
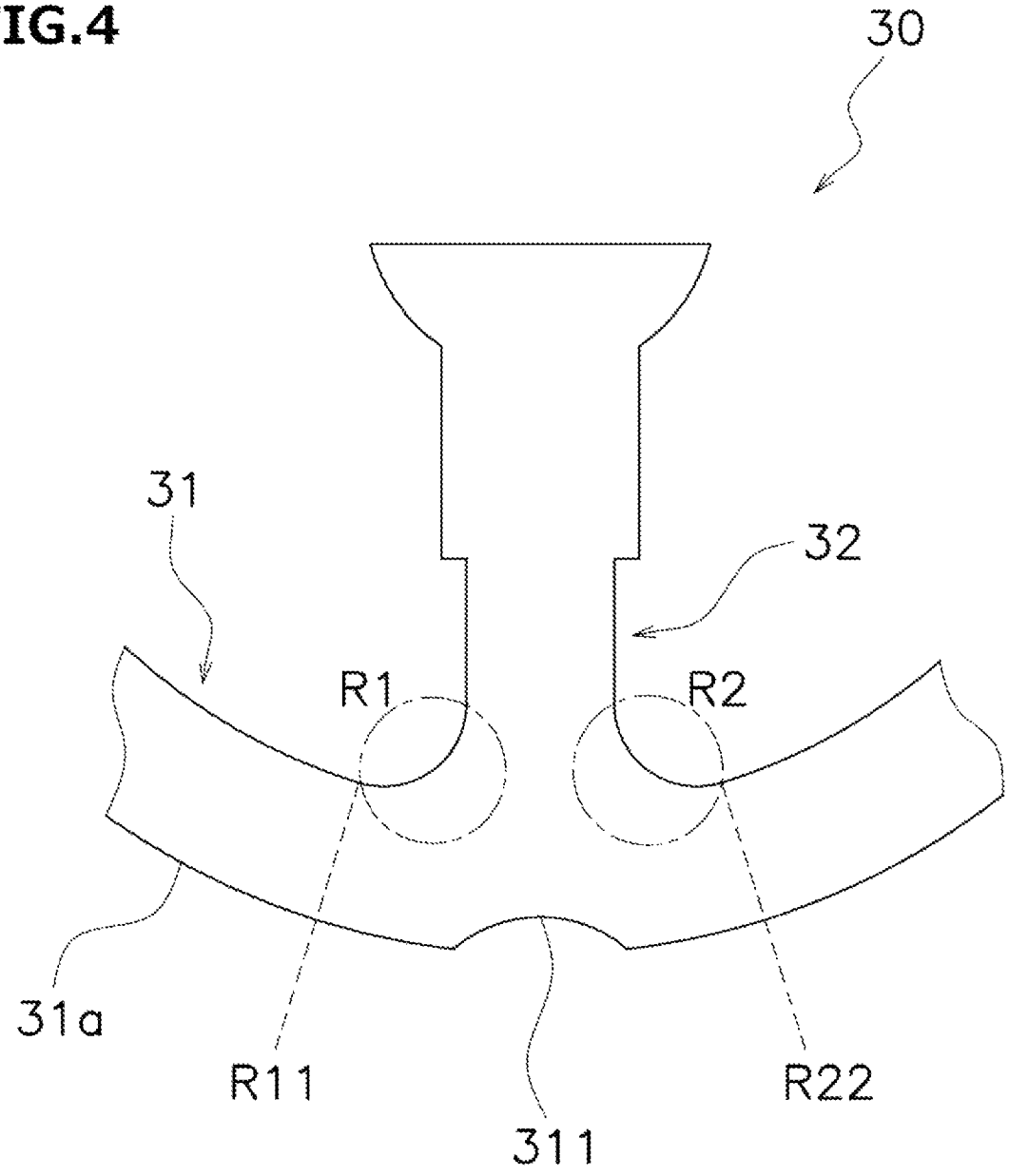
FIG. 4 is a view of part of the magnet holder 30 from above in the first embodiment.

As shown in FIG. 4, the groove 311 is preferably formed at a portion of the outer ring portion 31 connected to the beam 32. Due to the beam 32, such a portion has a high stiffness and is less likely to be distorted upon processing of the groove 311. Distortion of the magnet holder 30 is not preferred because a rotor shaft of the rotor 20 is shifted from the center. The groove 311 is preferably arranged between radii R11, R22 (a radius indicates a line connecting an outer end portion of a radius R1, R2 of a connection portion between the beam 32 and the outer ring portion 31 and the center of the outer ring portion 31) passing through such end portions.

<Variation 1A of First Embodiment>

Figure 5:
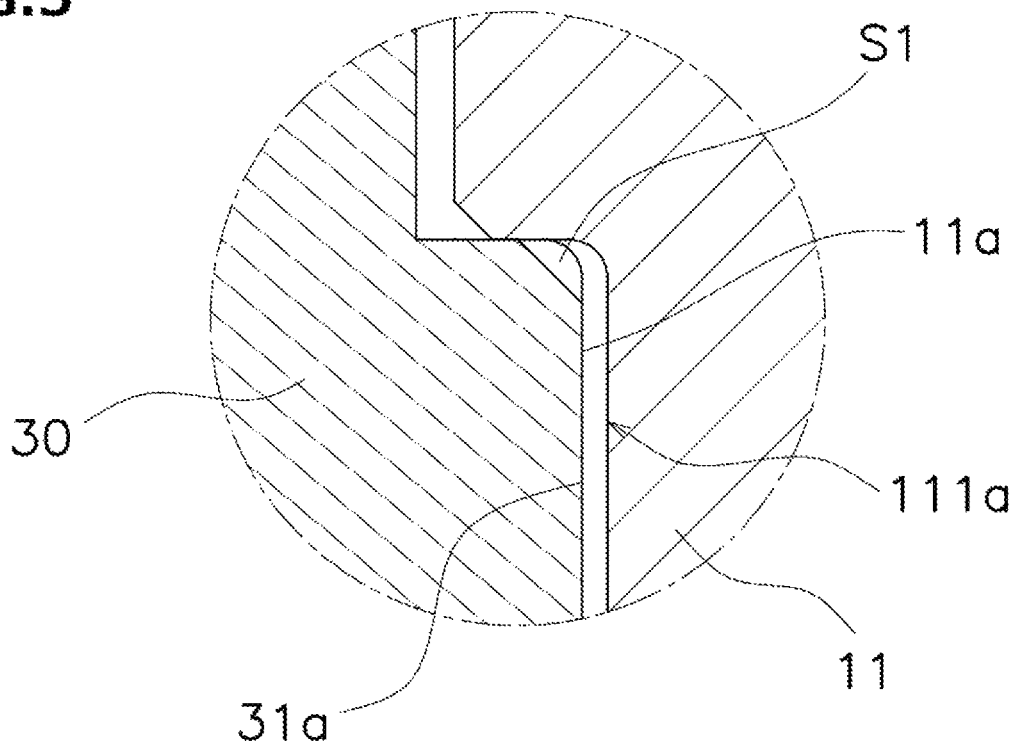
FIG. 5 is an enlarged view of a fitting portion between a step of an inner wall of a case 11 and a magnet holder 30 in the Variation 1A.

In the first embodiment, the grooves 311 allowing communication between the clearance S1 between the case 11 and the magnet holder 30 and the exhaust path in the case 11 are formed at the magnet holder 30, as shown in FIG. 2. In Variation 1A, a groove 111*a* is formed at the surface 11*a* of the case 11 extending in the upper-lower direction, as shown in FIG. 5. Other configurations of Variation 1A are the same as those of the first embodiment. In the case of Variation 1A, gas accumulated in the clearance S1 between the case 11 and the magnet holder 30 is also easily discharged to the exhaust path by way of the groove 111*a*, and occurrence of the slow leak is also reduced.

<Variation 1B of First Embodiment>

Figure 6:
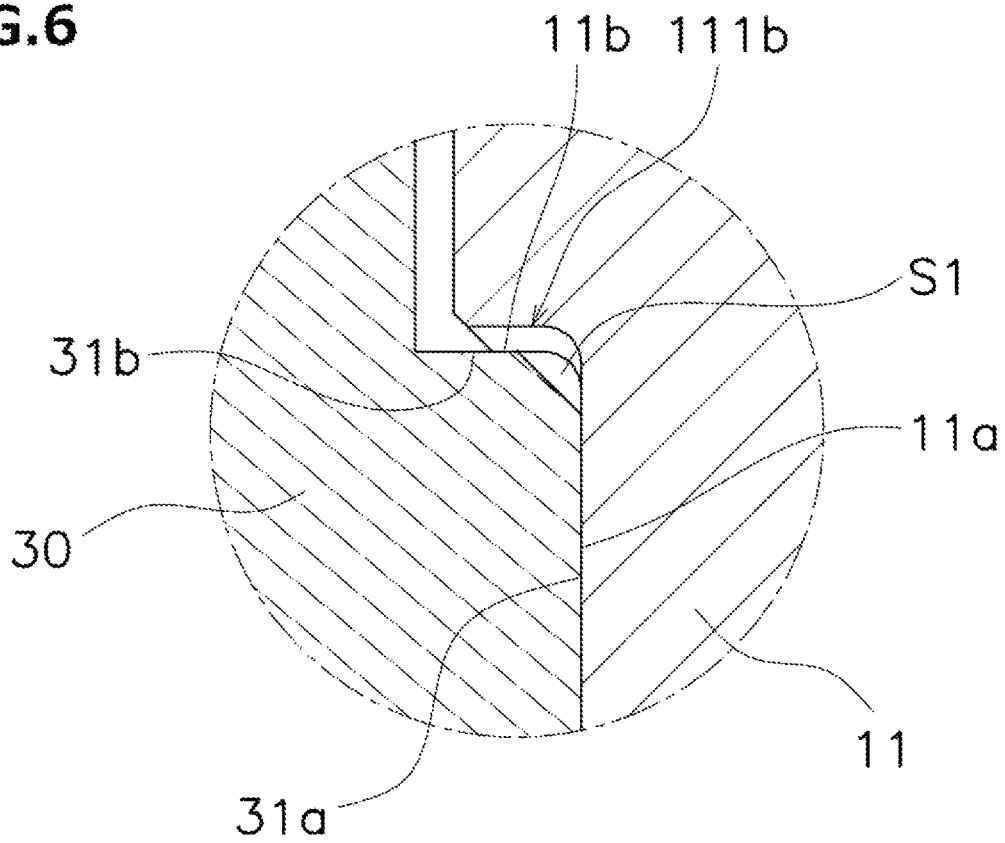
FIG. 6 is an enlarged view of a fitting portion between a step of an inner wall of a case 11 and a magnet holder 30 in the Variation 1B.

In Variation 1A, the groove 111*a* is formed at the surface 11*a* of the case 11 extending in the upper-lower direction. On the other hand, in Variation 1B, a groove 111*b* is formed at the surface 11*b* of the step of the case 11 extending in the radial direction, as shown in FIG. 6. Other configurations of Variation 1B are the same as those of the first embodiment. In the case of Variation 1B, gas accumulated in the clearance S1 between the case 11 and the magnet holder 30 is also easily discharged to the exhaust path by way of the groove 111*b*, and occurrence of the slow leak is also reduced. Specifically, the groove 111*b* communicates with the clearance between the magnet holder 30 and the case 11 on the upper side in the axial direction. The clearance between the magnet holder 30 and the case 11 on the upper side in the axial direction communicates with a space above the magnet holder 30. Thus, gas in the clearance S1 is discharged to the exhaust path upstream of the turbo-molecular pump by way of the groove 111*b* and the clearance between the magnet holder 30 and the case 11.

Second Embodiment

Figure 7:
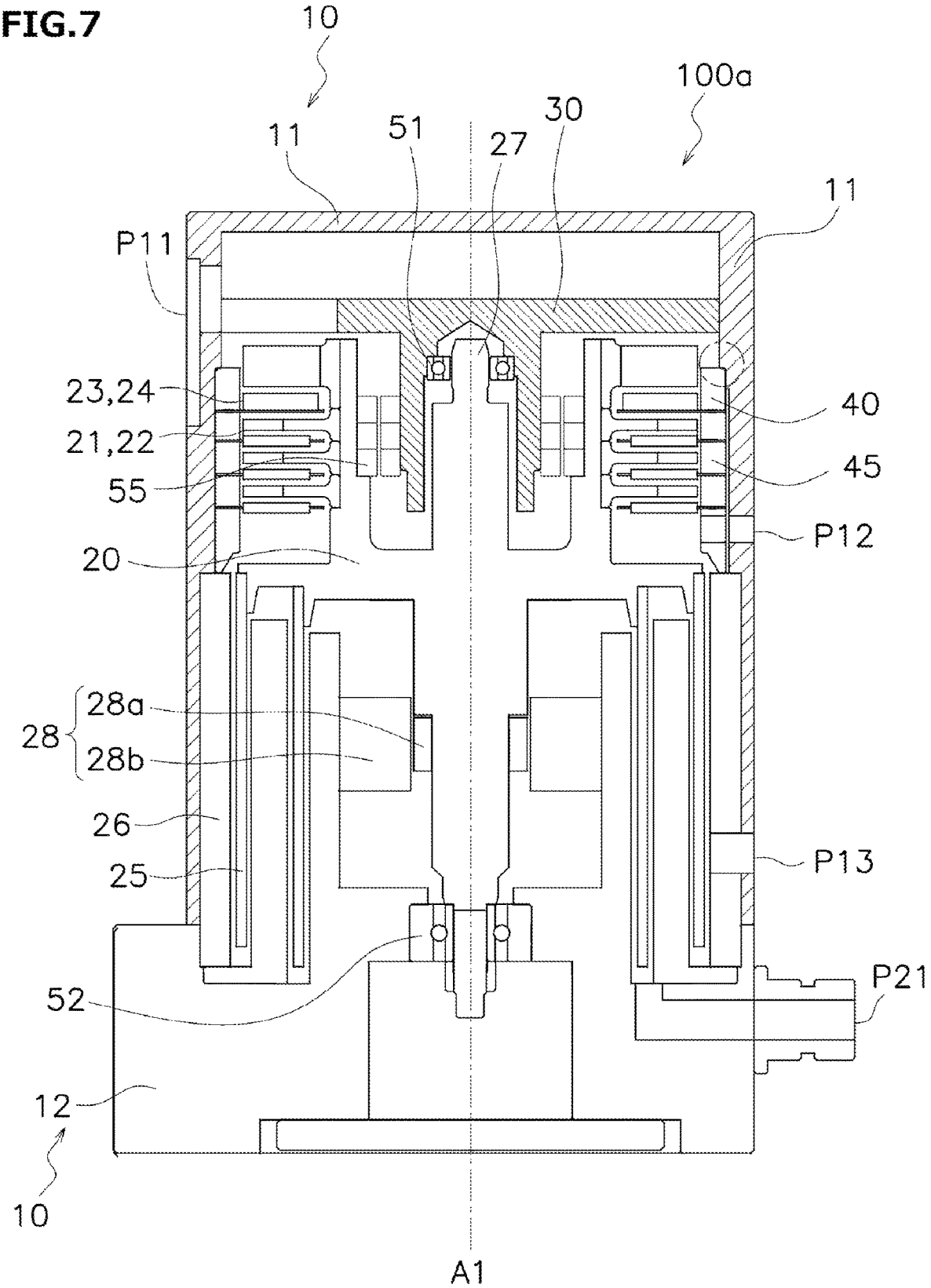
FIG. 7 is a sectional view of a vacuum pump 100*a* of a second embodiment.

In the vacuum pump 100 of the first embodiment, the magnet holder 30 is fitted in the step of the case 11. On the other hand, in a vacuum pump 100*a* of a second embodiment, a spacer 40 is fitted in a step of a case 11, as shown in FIG. 7. Other configurations of the vacuum pump 100*a* of the second embodiment are the same as those of the vacuum pump 100 of the first embodiment. In the second embodiment, a magnet holder 30 is fixed to a portion of an inner wall of the case 11 other than the step. Alternatively, the magnet holder 30 is integrated with the case 11.

The spacers 40, 45 are components for fixing stator blade units 23 to the case 11. The spacer 40 is a spacer at an uppermost stage, and is arranged above the spacers 45 in an axial direction A1. The spacers 40, 45 are in a ring shape. An outer peripheral surface 41 of the spacer 40 is arranged and fitted in contact with a surface 11*a* of the step of the inner wall of the case 11 extending in an upper-lower direction.

Figure 8:
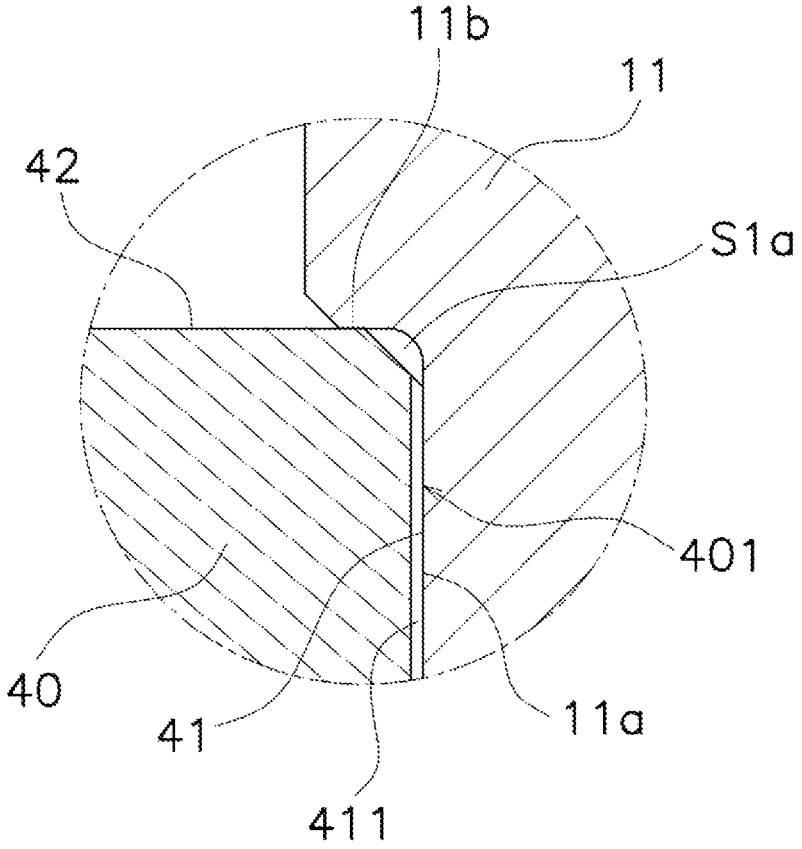
FIG. 8 is an enlarged view of a fitting portion between a step of an inner wall of a case 11 and a spacer 40 in the second embodiment.

As shown in FIG. 8, the spacer 40 includes the outer peripheral surface 41 and an upper surface 42. The step of the inner wall of the case 11 includes the surface 11*a* extending in the upper-lower direction and a surface 11*b* extending in a radial direction. The outer peripheral surface 41 of the spacer 40 is fitted in contact with the inner wall surface 11*a* of the case 11. Moreover, the upper surface 42 of the spacer 40 contacts the surface 11*b* of the case 11 forming the step. At the step of the inner wall of the case 11, a clearance S1*a* is formed between the case 11 and the spacer 40. If the clearance S1*a* is a closed space, a gas-accumulated space is formed, leading to slow leak.

In the present embodiment, a groove 411 is formed at the outer peripheral surface 41 of the spacer 40. The groove 411 causes the clearance S1*a* to communicate with other spaces in the case 11. The other spaces form an exhaust path. Thus, gas is easily discharged from the clearance S1*a*, and the slow leak is reduced. Specifically, the groove 411 communicates with a minute clearance (see FIG. 7) among the case 11 and the other spacers 45 positioned on an exhaust downstream side with respect to the spacer 40 at the uppermost stage. The clearance among the spacers 45 and the case 11 communicates with a second suction port P12 on the lower side, and therefore, communicates with the exhaust path between a turbo-molecular pump and a screw groove pump. Thus, gas in the clearance S1*a* is discharged to the exhaust path between the turbo-molecular pump and the screw groove pump by way of the groove 411 and the clearance among the spacers 45 and the case 11.

In the second embodiment, the case where the groove 411 is formed at the spacer 40 has been described. The groove may be formed at the case 11 as in Variation 1A and Variation 1B. In this case, gas is also easily discharged from the clearance S1*a* and the slow leak is also reduced, as in the second embodiment.

Each of the vacuum pumps 100, 100*a* according to the above-described embodiments is a combination pump configured such that a turbo-molecular pump and a screw groove pump are integrated. However, the turbo-molecular pump may be omitted. That is, the vacuum pump 100, 100*a* may include only the screw groove pump. Conversely, the screw groove pump may be omitted. That is, the vacuum pump 100, 100*a* may include only the turbo-molecular pump.

Third Embodiment

The present embodiment describes a leak detector 500 using the vacuum pump 100 of the first embodiment or the vacuum pump 100*a* of the second embodiment. Note that a vacuum pump 100 described herein indicates the vacuum pump 100 of the first embodiment or the vacuum pump 100*a* of the second embodiment.

Figure 9:
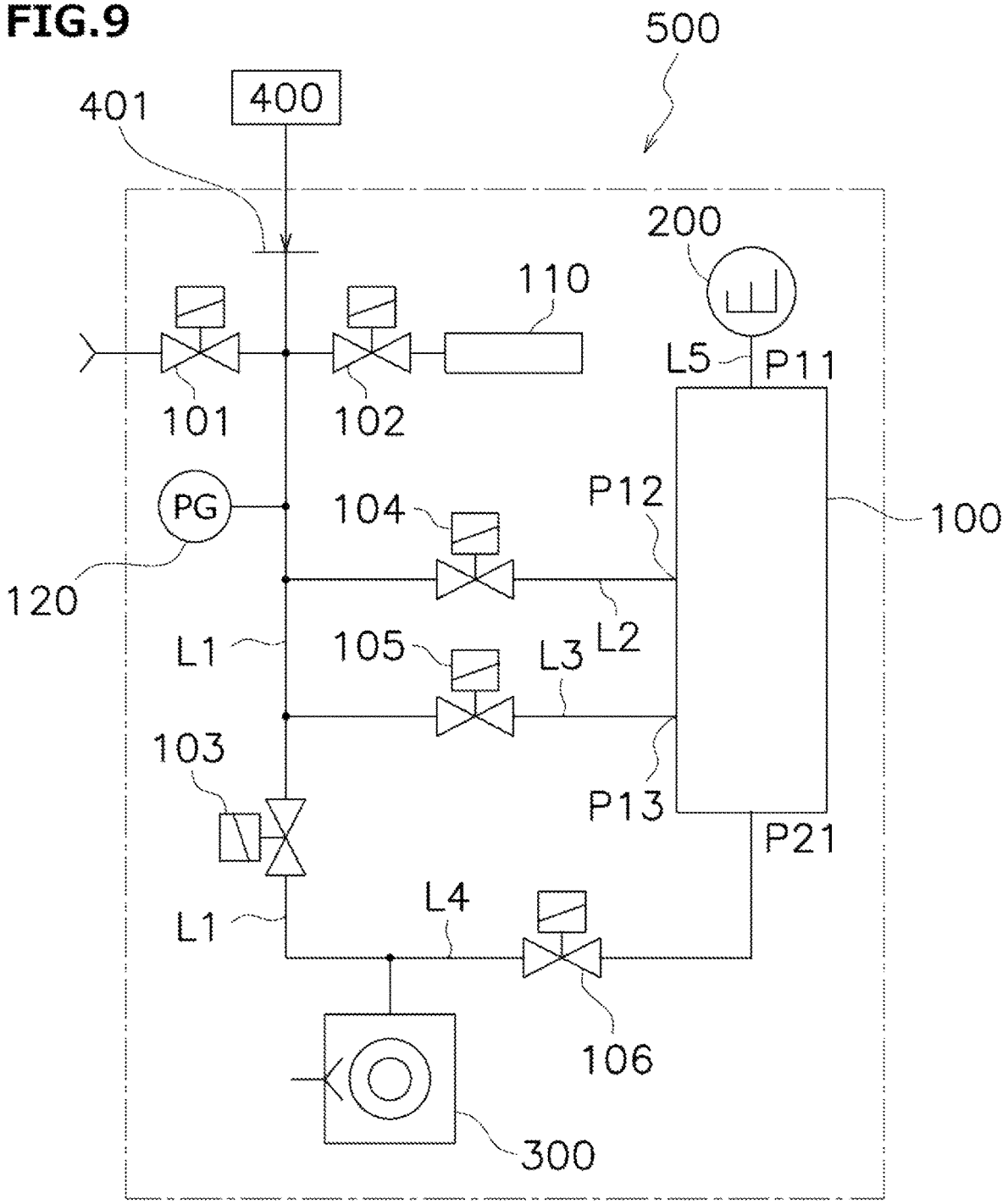
FIG. 9 is a diagram showing the configuration of a leak detector 500 of a third embodiment.

As shown in FIG. 9, the leak detector 500 includes the vacuum pump 100, an analyzer tube 200, a roughing pump 300, a test port 401, a calibration standard leak 110, a vacuum meter 120, valves 101 to 106, and pipes L1 to L5 connecting these components.

The leak detector 500 can be applied to the method for testing carrier gas leakage from a test sample. The testing method is either a method in which the inside of a test sample is brought into a vacuum state and carrier gas entering the test sample from the outside is analyzed or a method in which the inside of a test sample is filled with carrier gas and the carrier gas leaking to the outside of the test sample is analyzed. Helium gas is preferred as the carrier gas.

The test port 401 is connected to a test sample 400 or a container housing the test sample 400 so that the leaking carrier gas can be collected. The test port 401 is connected to the roughing pump 300 through the pipe L1. The roughing valve 103 is arranged in the middle of the pipe L1. The roughing pump 300 is, for example, an oil-sealed rotary pump.

The analyzer tube 200 is connected to a first suction port P11 of the vacuum pump 100 through the pipe L5. That is, gas is discharged from the analyzer tube 200 by the vacuum pump 100. An exhaust port P21 of the vacuum pump 100 is connected to the roughing pump 300 through the pipe L4. The foreline valve 106 is arranged in the middle of the pipe L4. That is, the roughing pump 300 is utilized as an auxiliary pump of the vacuum pump 100.

The test port 401 is connected to a second suction port P12 of the vacuum pump 100 through the pipe L2 and the test valve 104. Moreover, the test port 401 is connected to a second suction port P13 of the vacuum pump 100 through the pipe L3 and the test valve 105. In the vacuum pump 100, an exhaust path from the first suction port P11 to the exhaust port P21 is formed. The second suction ports P12, P13 are connected to the middle of the exhaust path. The second suction port P12 is connected to an upstream side of the exhaust path with respect to another second suction port P13. The second suction port P12 is connected to between a turbo-molecular pump and a screw groove pump of the vacuum pump 100. The other second suction port P13 is connected to the middle of the screw groove pump.

As shown in FIG. 9, the vent valve 101, the calibration valve 102, and the vacuum meter 120 are connected to the pipe L1. The calibration standard leak 110 is connected to the calibration valve 102. The calibration standard leak 110 is detachable. The vent valve 101 releases the pipe L1 to an atmospheric pressure. The vacuum meter 120 can detect the internal pressure of the pipe L1.

Next, a test sample leak check method using the leak detector 500 will be described. Note that the leak check method uses a principle called a back-diffusion measurement method. In the back-diffusion measurement method, the carrier gas (leak checking gas) is supplied to the middle or downstream side of the exhaust path of the vacuum pump 100, and a leak amount is obtained by detection of the carrier gas back-diffused to the upstream side of the exhaust path by the analyzer tube 200.

When the leak detector 500 is started, the roughing pump 300, the vacuum pump 100, and the analyzer tube 200 are started. The valve 106 is brought into an open state, and the other valves 101 to 105 are brought into a closed state. Gas is discharged from the analyzer tube 200 by means of the vacuum pump 100 until the analyzer tube 200 reaches a predetermined background value (the degree of vacuum).

After the test port 401 has been covered with a lid, the roughing valve 103 is opened, and gas is discharged from the pipe L1 by the roughing pump 300. When the pipe L1 reaches a predetermined pressure, the roughing valve 103 is closed, and thereafter, the test valve 105 and the calibration valve 102 are opened. As a result, the calibration carrier gas (helium gas) in the calibration standard leak 110 flows out to the pipe L1, and reaches the exhaust path of the vacuum pump 100 from the second suction port P13 through the test valve 105. Then, calibration is performed.

Next, a test sample leak check is performed. A case where a small container such as a package is, as the test sample, targeted for the leak check will be described. The test sample is filled with the carrier gas. The test sample is placed in a vacuum container connected to the test port 401. The roughing valve 103 is opened, and gas is discharged from the pipe L1 by the roughing pump 300. When the inside of the pipe L1 reaches a predetermined pressure, the roughing valve 103 is closed, and the test valve 105 is opened. The carrier gas having leaked from the test sample reaches the exhaust path in the vacuum pump 100 through the test valve 105 and the second suction port P13 of the vacuum pump 100. The back-diffused carrier gas is detected by the analyzer tube 200, and the leak amount is measured.

The case where the leak amount is measured using the pipe L3, the test valve 105, and the second suction port P13 has been described above. Similarly, higher-sensitivity measurement can be performed when the leak amount is measured using the pipe L2, the test valve 104, and the second suction port P12.

In the present embodiment, the vacuum pump 100 of the first embodiment or the vacuum pump 100*a* of the second embodiment is used, and therefore, gas is easily discharged from the clearance S1, S1*a* among the case 11 and other components (the magnet holder 30 or the spacer 40). Thus, influence of gas enclosed in the clearance S1, S1*a* on carrier gas detection in the analyzer tube 200 can be reduced. A leak gas detection speed can be increased.

The multiple embodiments of the present disclosure have been described above, but the present disclosure is not limited to the above-described embodiments and various changes can be made without departing from the gist of the present disclosure. Specifically, the multiple embodiments described in the present specification may be combined as necessary.

(3) Aspects

Those skilled in the art understand that the above-described multiple exemplary embodiments are specific examples of the following aspects.

(First Aspect)

A vacuum pump comprises: a rotor rotatable in a predetermined rotation direction; and a case housing the rotor; and a fixed component arranged facing an inner wall of the case. A clearance is formed between the inner wall of the case and the fixed component, and a groove allowing communication between the clearance and an exhaust path in the case is formed at either the inner wall of the case or the fixed component.

A vacuum pump according to a first aspect is configured such that a clearance is formed between a case and a fixed component arranged facing an inner wall of the case and a groove for discharging gas from the clearance is provided at the case or the fixed component. Thus, slow leak can be reduced.

(Second Aspect)

The case has a step having a surface extending in a radial direction and a surface extending in an axial direction, and the fixed component has a step having a surface extending in the radial direction and a surface extending in the axial direction, and the step of the case and the step of the fixed component are fitted in each other such that the clearance is formed between the step of the case and the step of the fixed component.

A vacuum pump according to a second aspect is configured such that a step of a case and a step of a fixed component are fitted in each other, and therefore, a clearance is easily formed. A groove is formed at the case or the fixed component so that slow leak can be reduced.

(Third Aspect)

The vacuum pump further comprises: a rotor blade of the rotor; a stator blade, the stator blade and the rotor blade forming a turbo-molecular pump; and multiple spacers sandwiching the stator blade in an axial direction for positioning. The clearance communicates with the exhaust path in the case through a clearance formed among the multiple spacers and the inner wall of the case.

A vacuum pump according to a third aspect is configured such that a clearance between a case and a fixed component communicates with an exhaust path in the case through a groove and a clearance formed between a spacer and an inner wall of the case. This prevents slow leak due to formation of a gas-accumulated space by the clearance between the case and the fixed component.

(Fourth Aspect)

The fixed component is a magnet holder holding a permanent magnet of a permanent magnet magnetic bearing.

A vacuum pump according to a fourth aspect includes a magnet holder, and therefore, a permanent magnet of a permanent magnet magnetic bearing can be properly held. Moreover, a clearance is formed between a case and the magnet holder, and a groove for discharging gas from the clearance is provided at the case or the magnet holder. Thus, slow leak can be reduced.

(Fifth Aspect)

The groove is formed at the magnet holder.

A vacuum pump according to a fifth aspect is configured such that a groove is formed at a magnet holder, and therefore, processing is facilitated as compared to the case of forming a groove at a case.

(Sixth Aspect)

The magnet holder has a beam extending in a radial direction from a center and an outer ring portion connected to the beam on an outer peripheral side thereof and contacting the case, and the groove is formed at a portion of the outer ring portion connected to the beam.

A vacuum pump according to a sixth aspect is configured such that a groove is formed at a portion connected to a high-stiffness beam, and therefore, a magnet holder is less likely to be distorted upon formation of the groove.

(Seventh Aspect)

The vacuum pump further comprises: a rotor blade of the rotor; a stator blade, the stator blade and the rotor blade forming a turbo-molecular pump; and multiple spacers sandwiching the stator blade in an axial direction for positioning. The fixed component is an uppermost spacer of the multiple spacers.

A vacuum pump according to a seventh aspect is configured such that a clearance is formed between a case and a spacer and a groove for discharging gas from the clearance is provided at the case or the spacer, and therefore, slow leak can be reduced.

(Eighth Aspect)

The groove is formed at the uppermost spacer.

A vacuum pump according to an eighth aspect is configured such that a groove is formed at a spacer, and therefore, processing is facilitated as compared to the case of forming a groove at a case.

(Ninth Aspect)

The groove is formed at the case.

A vacuum pump according to a ninth aspect is configured such that a groove is formed at a case, and therefore, the risk of causing distortion in the case of forming a groove at a fixed component can be reduced.

(Tenth Aspect)

A leak detector comprises: the vacuum pump including a first suction port, an exhaust port, and a second suction port connected to an exhaust path between the first suction port and the exhaust port; and an analyzer tube configured to detect leak checking gas. The analyzer tube is connected to the first suction port of the vacuum pump, and a test sample is connected to the second suction port of the vacuum pump.

A leak detector according to a tenth aspect is configured such that gas is easily discharged from a clearance S1, S1*a* among a case and other components. Thus, influence of gas enclosed in the clearance S1, S1*a* on carrier gas detection in an analyzer tube 200 can be reduced. A leak gas detection speed can be increased.

What is claimed is:

1. A vacuum pump comprising: a rotor rotatable in a predetermined rotation direction; and a case housing the rotor; and a fixed component arranged directly adjacent to and facing an inner wall of the case, wherein a clearance is formed between the inner wall of the case and the fixed component, and a groove allowing communication between the clearance and an exhaust path in the case is formed at either the inner wall of the case or the fixed component, wherein walls of the groove and the inner wall of the case or fixed component in which the groove is not formed define a discharge path which allows gas accumulated in the clearance to be discharged to the exhaust path.

2. A vacuum pump comprising:

a rotor rotatable in a predetermined rotation direction; and a case housing the rotor; and a fixed component arranged facing an inner wall of the case, wherein a clearance is formed between the inner wall of the case and the fixed component, a groove allowing communication between the clearance and an exhaust path in the case is formed at either the inner wall of the case or the fixed component, the case has a step having a surface extending in a radial direction and a surface extending in an axial direction, and the fixed component has a step having a surface extending in the radial direction and a surface extending in the axial direction, and the step of the case and the step of the fixed component are fitted in each other such that the clearance is formed between the step of the case and the step of the fixed component.

3. A vacuum pump comprising:

a rotor rotatable in a predetermined rotation direction; and a case housing the rotor; and a fixed component arranged facing an inner wall of the case, wherein a clearance is formed between the inner wall of the case and the fixed component, a groove allowing communication between the clearance and an exhaust path in the case is formed at either the inner wall of the case or the fixed component, and the fixed component is a magnet holder holding a permanent magnet of a permanent magnet magnetic bearing.

4. The vacuum pump according to claim 3, wherein the groove is formed at the magnet holder.

5. The vacuum pump according to claim 4, wherein the magnet holder has a beam extending in a radial direction from a center and an outer ring portion connected to the beam on an outer peripheral side thereof and contacting the case, and the groove is formed at a portion of the outer ring portion connected to the beam.

6. The vacuum pump according to claim 1, wherein the groove is formed at the case.

* * * * *